US009769585B1

(12) United States Patent
Hills

(10) Patent No.: US 9,769,585 B1
(45) Date of Patent: Sep. 19, 2017

(54) POSITIONING SURROUND SOUND FOR VIRTUAL ACOUSTIC PRESENCE

(71) Applicant: Sprint Communications Company L.P., Overland Park, KS (US)

(72) Inventor: Patrick J. Hills, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 192 days.

(21) Appl. No.: 14/015,343

(22) Filed: Aug. 30, 2013

(51) Int. Cl.
*H04R 5/00* (2006.01)
*H04S 5/00* (2006.01)

(52) U.S. Cl.
CPC ..... *H04S 5/00* (2013.01)

(58) Field of Classification Search
None
See application file for complete search history.

(56) References Cited

U.S. PATENT DOCUMENTS

2003/0059070 A1* 3/2003 Ballas ..... 381/309
2003/0227476 A1* 12/2003 Wilcock et al. ..... 345/727
2011/0299707 A1* 12/2011 Meyer ..... 381/310
2014/0002582 A1* 1/2014 Bear et al. ..... 348/14.08
2014/0126758 A1* 5/2014 Van Der Wijst ..... H04S 7/304 381/310
2014/0153751 A1* 6/2014 Wells ..... H04S 7/304 381/303
2014/0372944 A1* 12/2014 Mulcahy et al. ..... 715/810

* cited by examiner

*Primary Examiner* — Joseph Saunders, Jr.
*Assistant Examiner* — James Mooney

(57) ABSTRACT

Methods and systems for positioning audio signals on virtual soundstages. The mobile device may include one or more orientation components that are used to generate orientation data that track directional changes that are used to position an audio signal on a virtual soundstage. A listener of the sound from the audio signal may be associated with the orientation data such that the positioning of the audio signal provides virtual acoustic presence on the virtual soundstage. The audio signal is received, the audio signal may be associated with a plurality audio channels. The orientation data for positioning the audio signal is also received. A position for the audio signal on the virtual soundstage is determined based in part on the orientation data. The audio signal is then positioned on the virtual soundstage.

20 Claims, 7 Drawing Sheets

POSITIONING SURROUND SOUND FOR VIRTUAL ACOUSTIC PRESENCE

SUMMARY

A high-level overview of the invention is provided here to disclose and to introduce a selection of concepts that are further described below in the detailed-description section. This summary is not intended to identify key features or essential features of the claimed subject matter, nor is it intended to be used as an aid in isolation to determine the scope of the claimed subject matter.

In brief and at a high level, this disclosure describes, among other things, systems and methods for positioning audio signals on virtual soundstages. A mobile device may include one or more orientation components that are used to generate orientation data. The orientation data include directional changes that are used in positioning an audio signal on a virtual soundstage. A listener of the sound from the audio signal may be associated with the orientation data such that the positioning of the audio signal provides virtual acoustic presence on the virtual soundstage. The virtual soundstage may include a plurality of speakers that are used to simulate the acoustic presence of the listener on the virtual soundstage. In operation, the audio signal is received, the audio signal may be associated with a plurality audio channels. In embodiments, the audio signal is further converted to a virtual surround sound audio signal using aural cues, thus, virtual acoustic presence includes positioning simulated surround sound. The orientation data for positioning the audio signal is received from the one or more orientation components. A position for the audio signal on the virtual soundstage is determined based in part on the orientation data. The audio signal is then positioned on the virtual soundstage.

BRIEF DESCRIPTION OF SEVERAL VIEWS OF THE DRAWINGS

Illustrative embodiments of the present invention are described in detail below with reference to the attached drawing figures, and wherein.

DETAILED DESCRIPTION

Figure 1:
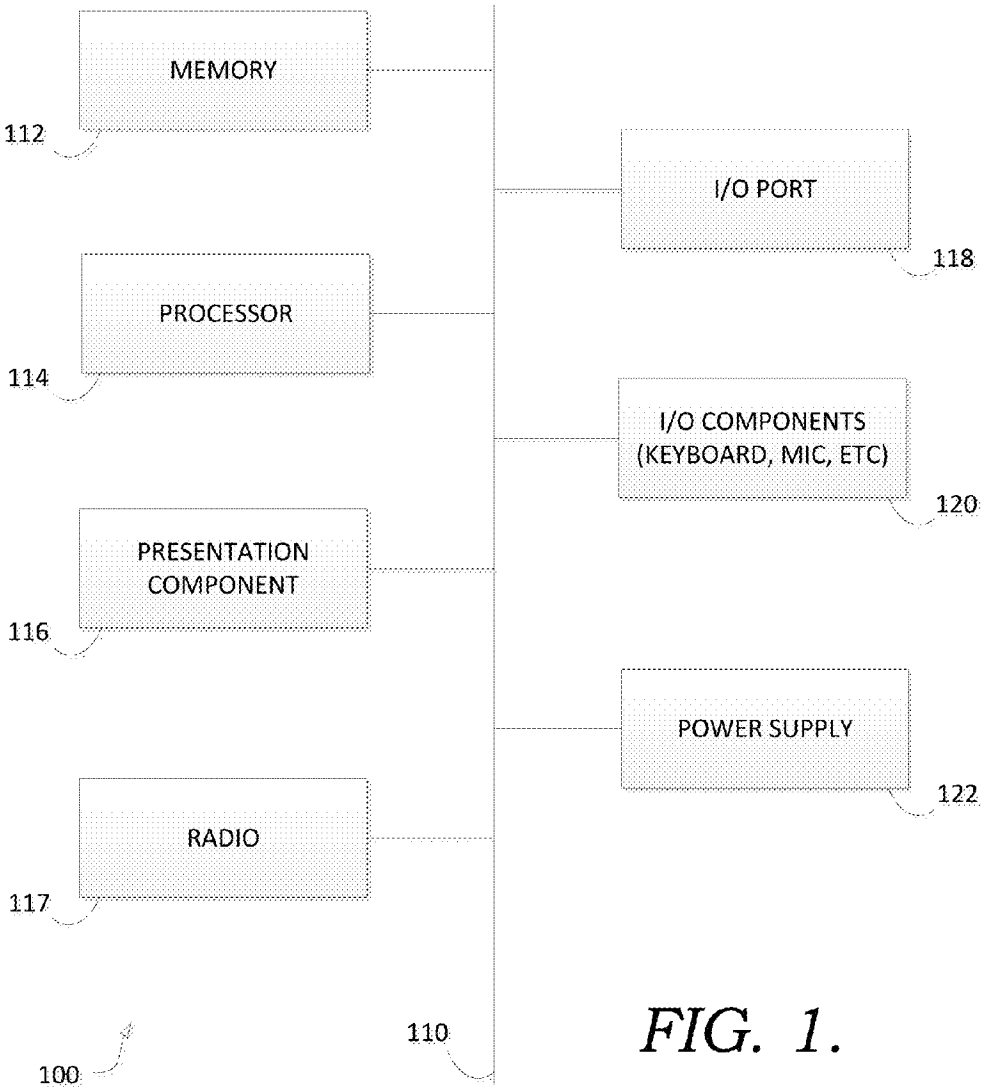
FIG. 1 depicts a block diagram of a mobile device in accordance with an embodiment of the present invention.

The subject matter of select embodiments of the present invention is described with specificity herein to meet statutory requirements. But the description itself is not intended to define what we regard as our invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described. Throughout this disclosure, several acronyms and shorthand notations are used to aid the understanding of certain concepts pertaining to the associated system and services. These acronyms and shorthand notations are intended to help provide an easy methodology of communicating the ideas expressed herein and are not meant to limit the scope of the present invention.

Embodiments of our technology may be embodied as, among other things, a method, system, or set of instructions embodied on one or more computer-readable media. Computer-readable media include both volatile and nonvolatile media, removable and non-removable media, and contemplate media readable by a database, a switch, and various other network devices. Computer-readable media include media implemented in any way for storing information. Examples of stored information include computer-useable instructions, data structures, program modules, and other data representations. Media examples include RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

A mobile device generally refers to a handheld computing device (e.g., handsets, smartphones or tablets). It may include a display screen with touch input and/or a miniature keyboard. The mobile device may run an operating system and various types of software. In embodiments of the present invention, a mobile device includes a headphone or a headset, which may be combined with a microphone. Headphones may include functional features (e.g., processor, input/output port, memory, and orientation components) usually associated with a mobile device. Headphones may provide a range of functionality including game audio for video games. Mobile devices receive audio signals from either an internal audio source or an external audio source. For example, a tablet may have audio files stored in memory on the tablet, which are then played back at the tablet, or a smartphone may use wired or wireless technology to playback audio files stored at an external location. The audio source may refer to either a device communicating the audio signal or an audio file used to generate the audio signal. For example, headphones may be plugged into an external device, which then communicates the audio signal from the external device to the headphones, or a tablet may store an audio format (e.g., MP3) in memory that is communicated as an audio signal.

An audio signal generally refers to a representation of sound. Audio signals may be characterized in parameters such as bandwidth, power, and voltage levels. An audio signal may alternatively be represented Pulse Code Modulation (PCM) that digitally represents sampled audio signals. Conventionally, PCM is the standard form of digital audio in computers. Sound may be stored in a variety of audio formats or physical methods used to store data. In some cases, sound may be presented as stereophonic sound or stereo as it is more commonly known, that provides direction and perspective to sound using two independent audio channels. In other cases, sound may be alternatively provided as multichannel sound (e.g., surround sound) that includes more than two audio channels that surround the listener. Generally, sound, such as stereo sound or surround sound, is perceived based on psychoacoustics. Psychoacoustics describes sound perception as a function of both the ear and the brain. In this regard, the sound a listener hears is not limited to a mechanical phenomenon of just hearing the sound with the ear but also includes the way the brain of the listener makes meaning of the sound. Psychoacoustics also includes how a listener locates sound. Sound localization involves the brain locating the source of sound using differences in intensity, spectral cues, and timing cues. As such, psychoacoustics plays an important role in how a listener perceives sound in a physical space where the person is present.

Surround sound may provide enriched sound reproduction quality of an audio source, in that, additional channels from speakers surround the listener. Conventionally, surround sound is presented from a listener's forward arc. Surround sound perception is a function of sound localization; a listener's ability to identify the location or origin of a detected sound in direction and distance. Surround sound may use different types of media, including, Digital Video Discs (DVD), High Definition Television (HDTV) encoded as compressed DOLBY DIGITAL and DTS formats. Surround sound or multichannel audio techniques are used to reproduce content as varied as music, speech, natural and synthetic sounds for cinema, television, broadcasting, video games, or computers.

Surround sound can be created by using surround sound recording microphone techniques and/or mixing-in surround sound for playback on an audio system using speakers encircling the listener to play the audio from different directions. Generating surround sound may further include mapping each source channel into its own speaker. In this regard, the audio signal channels can be identified and applied to respective speakers. The audio signal may encode the mapping information such that the surround sound is rendered for playing by a decoder processing the mapping information to audio signals that are sent to different speakers. Surround sound may also include low-frequency effects that require only a fraction of the bandwidth of other audio channels. This is usually the 0.1 channel in surround sound notation (e.g., 5.1 or 7.1). Low-frequency effects are directed to a speaker specifically designed for low-pitched sounds (e.g., subwoofer).

Further, surround sound can be presented as simulated surround sound (e.g., virtual surround sound) in a two-dimensional sound field with headphones. Simulated surround sound may include surround sound achieved by mastering levels which use digital signal processing analysis of stereo recordings to parse out individual sounds to component panorama positions. As such, mobile devices may be configured to manipulate audio signals to change sound perception. Mobile devices may utilize technology in the form of chipsets and/or software that support digital processing to simulate surround sound from a 2 channel stereo input or other multichannel input (e.g., DOLBY HEADPHONE technology or DTS SURROUND SENSATION technology). The technology includes algorithms that create an acoustic illusion of surround sound. Such technology may be incorporated into any type of audio or video product normally featuring a headphone outlet. The technology may be implemented using a chipset (e.g., DOLBY ADSST-MELODY 1000) that accepts a number of digital audio formats for digital audio processing. The technology may alternatively be implemented using software or application specific integration circuits.

Digital analysis techniques enable providing surround sound on stereo headphones. A virtual surround sound environment may be created in real-time using any set of two-channel stereo headphones. In operation, the analysis technique can take a multichannel (including a 2 channel input) and send as output a 2 channel stereo signal that includes audio cues intended to place the input channels in a simulated virtual soundstage. The signal processing may create the sensation of multiple loud speakers in a room. For example, DOLBY DIGITAL technology provides signal processing technology that delivers 7.1 channel surround sound over any pair of headphones for richer, more spacious headphone audio. Digital analysis techniques are based on algorithms that determine how sounds with different points of origins or how a single sound interacts with different parts of the body. The algorithm essentially is a group of rules that describe the Head-related transfer function (HRTF) and other factors change the shape of the sound wave. HRTF refers to a response that characterizes how an ear receives a sound from a point in space. A listener estimates the location of source by taking cues derived from one ear and comparing cues received at both ears. Among the differences are time differences of arrival and intensity differences. HRTF describes how a given sound wave input that may be defined in frequency and source location is filtered by diffraction and reflection properties of the head, pinna and torso, before the sound reaches the ears. With an appropriate HRTF, the signals required at the eardrums for the listener to perceive sound from any direction may be calculated.

At a basic level, the process adds aural cues to sound waves, convincing the brain into interpreting the sound as though it came from multiple speakers on a virtual soundstage (e.g., fives sources instead of two). In this regard, virtual surround sound creates the perception that there are many sources of sound than are actually present. A virtual soundstage refers to the simulated physical environment created by the surround sound experience. Virtual surround sound produces a multichannel surround sound experience on the virtual soundstage without the need for actual physical speakers. The virtual surround sound through headphones provides a perceived surround sound experience on the virtual soundstage.

Embodiments of the present invention provide an efficient method for positioning audio signals on virtual soundstages such that a listener experiences virtual surround sound that is augmented by providing virtual acoustic presence. Acoustic presence may be simulated based on audio cues that are used to manipulate sound to provide virtual surround sound on the virtual soundstages and orientation data referenced from a mobile device orientation component to further position the sound on the virtual soundstage. For example, when a listener that is listening to virtual surround sound turns (e.g., 30° from an initial position), the virtual soundstage is maintained relative to the listener. In the case of a surround sound recording of multiple audio signals from multiple musicians, a listener may audibly or virtually face different audio signals/musicians on a virtual surround sound stage as the listener turns. In a gaming context, a listener may identify position relative to the listener's viewing position on the screen. As such, embodiments of the present invention provide for positioning the audio signal on the virtual soundstage such that simulating virtual surround sound further incorporates orientation data to maintain the virtual soundstage with reference to the listener's change in orientation as calculated by the orientation data from the mobile device.

For purposes of a detailed discussion below, a mobile phone including one or more orientation components is described. Further, while embodiments of the present invention may generally refer to the components described, it is understood that an implementation of the techniques described may be extended to cases with different components carrying out the steps described herein. It is contemplated that embodiments of the present invention may utilize orientation data from the mobile device (e.g., mobile handset or headphones). A mobile device may include one or more orientation components. An orientation component may refer to a component used to obtain directional changes made at the mobile device. An orientation component may be implemented as software or hardware or a combination thereof. By way of example, a mobile device may be embedded with a gyroscope, an accelerometer, a magnetometer, or a user interface, each of these components may provide orientation data (e.g., positional changes of the mobile device) communicated for positioning surround sound. Any other variations and combinations of orientation components are contemplated within the scope of embodiments of the present invention.

In a first aspect of the present invention, computer-readable media having computer-executable instructions embodied thereon that, when executed, enable a computing device to perform a method for positioning audio signals on virtual soundstages. The method includes receiving an audio signal. The method also includes receiving orientation data from an orientation component at a mobile device, the orientation data used for positioning the audio signal. The method further includes determining a position for the audio signal on a virtual soundstage based on the orientation data. The method also includes positioning the audio signal on the virtual soundstage.

In a second aspect of the present invention, computer-readable media having computer-executable instructions embodied thereon that, when executed, enable a computing device to perform a method for positioning audio signals on virtual soundstages. The method includes receiving an audio signal having a first set of channels. The method also includes generating from the audio signal having a first set of channels, an audio signal having a second set of channels. The method further includes referencing orientation data for positioning the audio signal having the second set of channels. The method also includes generating a virtual surround sound audio signal based on the orientation data and the audio signal having the second set of channels. Generating the virtual surround sound audio signal comprises: determining position indicators based on the orientation data for positioning the audio signal on the virtual soundstage and determining audio cues for simulating virtual surround sound for the audio signal. The method further includes communicating the virtual surround sound audio signal comprising the position indicators and the audio cues. The virtual audio signal is output to two audio channels that simulate a plurality of virtual audio channels on the virtual soundstage.

In a third aspect of the present invention, a system is provided for positioning audio signals on virtual soundstages. The system includes an orientation component configured for generating orientation data of the mobile device. The orientation data tracks directional changes of the mobile device. The orientation component also communicates the orientation data for positioning the audio signal. The orientation data includes multidimensional positioning data. The system also includes a positioning component configured for generating virtual surround sound audio signal based on a received audio signal. Generating the virtual surround audio signal comprises: determining position indicators based on the orientation data for positioning the audio signal on a virtual soundstage and determining audio cues for simulating virtual surround sound for the audio signal. The positioning component is also configured for communicating the virtual surround sound audio signal comprising the position indicators and the audio cues as audio signals onto a virtual soundstage.

Turning now to FIG. 1, a block diagram of an illustrative mobile device is provided and referenced generally by the numeral 100. Although some components are shown in the singular, they may be plural. For example, mobile device 100 might include multiple processors or multiple radios, etc. As illustratively shown, mobile device 100 includes a bus 110 that directly or indirectly couples various components together including memory 112, a processor 114, a presentation component 116, a radio 117, input/output ports 118, input/output components 120, and a power supply 122.

Memory 112 might take the form of one or more of the aforementioned media. Thus, we will not elaborate more here, only to say that memory component 112 can include any type of medium that is capable of storing information in a manner readable by a computing device. Processor 114 might actually be multiple processors that receive instructions and process them accordingly. Presentation component 116 includes the likes of a display and a speaker, as well as other components that can present information (such as a lamp (LED), or even lighted keyboards).

Radio 117 represents a radio that facilitates communication with a wireless telecommunications network. Illustrative wireless telecommunications technologies include Long Term Evolution (LTE) and Evolved Data Optimized (EVDO) and the like. In some embodiments, radio 117 might also facilitate other types of wireless communications including Wi-Fi communications.

Input/output port 118 might take on a variety of forms. Illustrative input/output ports include a USB jack, stereo jack, infrared port, proprietary communications ports, and the like. Input/output components 120 include items such as keyboards, microphones, touchscreens, and any other item usable to directly or indirectly input data into mobile device 100. Power supply 122 includes items such as batteries, fuel cells, or any other component that can act as a power source to power mobile device 100.

Figure 2:
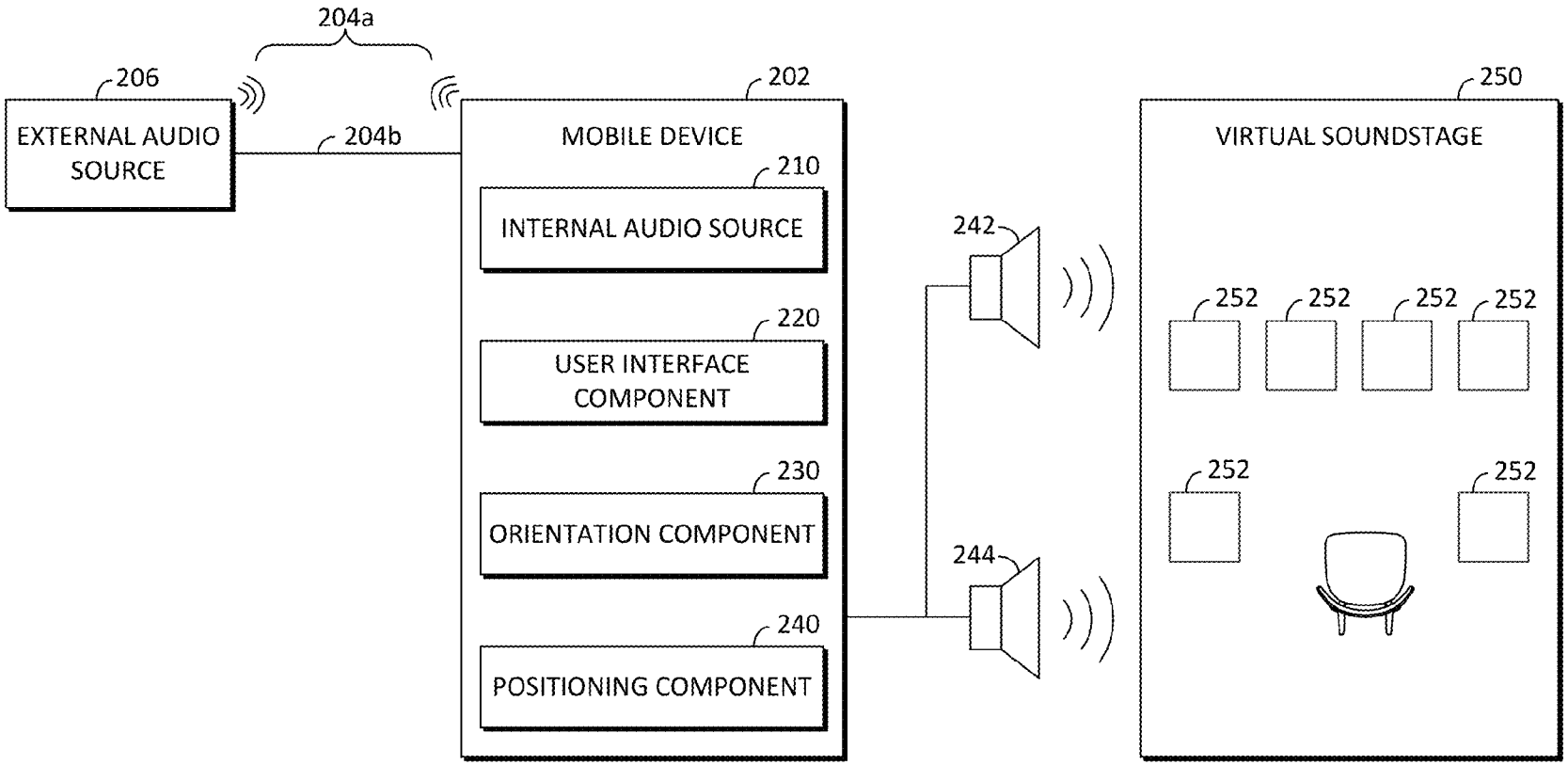
FIG. 2 depicts an illustrative operating environment for carrying out embodiments of the present invention.

FIG. 2 depicts an illustrative operating environment, referenced generally by the numeral 200, which enables positioning audio signals on virtual soundstages. Mobile device 202, in one embodiment, is the type of device described in connection with FIG. 1 herein. Mobile device 202 may communicate with a wireless communication network or other components not internal to the mobile device 202. The mobile device 202 may communicate using a communications link **204*a*. The communications link 204*a*** may be a short-range connection, a long-range connection, or a combination of both a short-range and a long-range wireless telecommunications connection. When we refer to "short" and "long" types of connections, we do not mean to refer to the spatial relation between two devices. Instead, we are generally referring to short range and long range as different categories, or types, of connections (i.e., a primary connection and a secondary connection). A short-range connection may include a Wi-Fi connection to a device (e.g., mobile hotspot) that provides access to a wireless communications network, such as a WLAN connection using 802.11 protocol. A long-range connection may include a connection using one or more of, by way of example, Long Term Evolution (LTE) or Evolution-Data Optimized (EVDO) networks.

In embodiments, mobile device 202 may include a client service (not shown) that facilitates carrying out aspects of the technology described herein. The client service may be a resident application on the mobile device, a portion of the firmware, a stand-alone website, or a combined application/web offering that is used to facilitate generating and transmitting information relevant to positioning audio signals on virtual soundstages. Whenever we speak of an application, software, or the like, we are really referring to one or more computer-readable media that are embodied with a set of computer-executable instructions that facilitate various actions to be performed. For readability purposes, we will not always include this lengthy terminology.

An audio signal, in accordance with embodiments of the present invention, may be received from an audio source (e.g., external audio source 206 and internal audio source 210). Audio signals refer to a representation of sound that can be characterized in parameters such as bandwidth, power, and voltage levels. Sound may be stored in variety of audio formats or physical methods used to store data. Sound may be communicated wirelessly using the communications link 204*a* as discussed above. In some cases, sound may be communicated using a wired link 204*b*. A wired link generally refers to a physical electrical connection between a source and a destination of the audio signal. The physical electrical connection may be an electrical conductor that carries the audio signal from the source to the destination. Wired connections are well known in the art; as such they are not further discussed herein. The external audio source 206 and the internal audio source 210 may communicate an audio signal to a component (e.g., positioning component) at the mobile device, the component then facilitates positioning the audio signal. By way of example, a mobile device may have audio files stored in memory of the mobile device or an external storage may wirelessly communicate an audio signal to the headphones. Any other variations and combinations of audio sources are contemplated within the scope of embodiments of the present invention.

The mobile device 202 includes a user interface component 220. Such a user interface component can control interface features associated with positioning audio signals on virtual soundstages. The user interface component 220 includes a variety of different types of interfaces, such as, a touchscreen interface, a voice interface, a gesture interface, and a direct manipulation interface. The user interface component 220 may further include controls to calibrate and to turn on and off the positioning capabilities. The user interface component 220 can include orientation defaults and orientation presets for simplifying particular orientation configurations for the mobile device. The user interface component 220 can provide controls for selecting one or more orientation components used in referencing orientation data of the mobile device. In embodiments, the user interface component 220 may function to directly provide orientation data communicated via the user interface. Further, the user interface component 220 may receive information for calibrating specific features of the virtual soundstage (e.g., 5.1, 7.1 or 11.1 surround sound) and indicating thresholds for the one or more orientation components. Any other variations and combinations of user interface features and controls are contemplated within the scope of embodiments of the present invention.

With continued reference to FIG. 2, the orientation component 230 is generally responsible for generating orientation data. In this regard, the orientation component 230 supports determining the location of a listener in n-dimensional. The orientation component may also determine the location of the listener using the orientation data associated with the listener. The orientation data may include coordinates that define a first position and then a second position upon a change in the position of the listener. In embodiments, the orientation component may measure a change in the position i.e., location and/or direction of a listener relative to a point of origin of the listener. For example, a two or three dimensional coordinate system may be used to define the position of listener on virtual soundstage and the change in the listener's position in the virtual soundstage can be captured by the orientation component. Any other variations and combinations of location tracking and positioning systems are contemplated within the scope of embodiments of the present invention.

Orientation data at the orientation component 230 may be captured using several different methods. By way of example, the orientation component 230 of the mobile device may include one or more orientation data units (not show) such as an interface, gyroscope, an accelerometer, or a magnetometer, where each provide orientation data (e.g., positional changes of the mobile device) communicated for positioning surround sound. The orientation component 230 may comprise a sensor that measures position changes and converts it into a signal which may be interpreted. The sensors may be calibrated with different sensitivities and thresholds to properly execute embodiments of the present invention. It is further contemplated within embodiments of the present invention that a mobile device 202 may include any number and different types of orientation data units. Each type of orientation data unit may generate different types of orientation data which may be factored into a positioning algorithm. It is further contemplated that the orientation data from a first orientation data unit may overlap with orientation data from a second orientation data unit. Whether distinct or overlapping, the orientation data from the different types of orientation data units may be combined in performing calculations for positioning the audio signal.

An accelerometer, for example, may measure the linear acceleration of the device. The accelerometer measures proper acceleration, an accelerometer sensor may measure acceleration relative to a free falling frame of reference. In particular, when the mobile device 202 is static, in whatever orientation, the orientation data represents the force of gravity acting on the device, and corresponds to the roll and pitch of the device (in the X and Y directions at least). But while in motion, the orientation data represents the acceleration due to gravity, plus the acceleration of the device itself relative to its rest frame. An accelerometer may measure the magnitude and direction of acceleration and can be used to sense the orientation of the mobile device 202.

A gyroscope refers to an exemplary orientation data unit for measuring and/or maintaining orientation based on principles of angular momentum. The angular momentum data represents rotational inertia and rotational velocity about an axis of the mobile device. For example, with the inclusion of a gyroscope, a user may simply move the mobile device 202 or even rotate the mobile device 202 and receive orientation data representing the directional changes. A gyroscope may sense motion including vertical and horizontal rotation. The accelerometer measurements of a mobile device 202 may be combined with the gyroscope measurements, to create orientation data for a plurality of axes, for example, six-axes: up and down, left and right, forward and backwards, as well as the roll, pitch and yaw rotations.

The mobile device 202 may include another exemplary orientation data unit, a magnetometer that measures the strength and/or direction of magnetic fields. A magnetometer may be integrated into circuits installed on a mobile device. A magnetometer on a mobile device 202 can be used to measure a three-dimensional space around the mobile device 202. The orientation data of the magnetometer may be combined with any of the other orientation components to generate different types of orientation data. For example, an accelerometer may measure the linear acceleration of the device so that it can report its roll and pitch, but combined with the magnetometer orientation data may have roll, pitch, and yaw measurements. Moreover, orientation data may be used to define particular gesture classifications that can be communicated and interpreted to execute predefined positioning features of the audio signal. For example, turning the mobile device 202 sideways may be associated with a specific predefined effect to the position of the audio signal on the virtual soundstage. Any other variations and combinations of mobile device based gestures are contemplated within the scope of embodiments of the present invention.

In embodiments, the user interface component 220 may be configured to directly receive orientation information in a two-dimensional or three-dimensional space, in this regard also functioning as an orientation data unit of the orientation component 230. A user interface component 220 may include a direct manipulation interface of a virtual soundstage where orientation data is captured based on inputs to the interface. The user interface component 220 may also receive discrete entries for a plurality of dimensions which are converted into orientation data for processing. In addition, orientation data may further be captured based on elements featured in video. Particular elements in video may be identified for determining changes in orientation, therefore, generating orientation data which may be referenced for positioning an audio signal on the virtual soundstage. By way of example, a video game (e.g., a first person shooter game) may include a video element (e.g., a video game character) whose positioning is used to generate orientation data, thus, the audio signal is positioned based on the directional changes of this video element. Any other variations and combinations of sources of orientation data for positioning audio signals are contemplated within the scope of embodiments of the present invention.

With continued reference to FIG. 2, the positioning component 240 is generally responsible for providing digital processing of the received audio signal to determine a position for the audio signal. Digital processing techniques may include the manipulation of audio signals to change sound perception. In embodiments, the manipulation of audio signals includes positioning the audio signals based on, the orientation data received from the orientation component 230 and/or aural cues used in creating virtual surround sound. By way of example, the algorithms that create the acoustic illusion of surround sound further factor in the orientation data of the listener captured by the orientation component 230. The positioning component 240 performs digital analysis that enables providing surround sound on stereo headphones and also maintaining the virtual soundstage of the surround sound. Maintaining the virtual soundstage may include a listener turning on the virtual soundstage and experiencing the sound as emanating from the same position relative to a position of origin even as the user turns. Further, a user may step back from the virtual sound stage and this time experience a distant virtual speaker stereo sound or single virtual speaker sound emanating from the virtual soundstage in front of the listener. The listener may further amplify sound in any direction on the virtual soundstage by stepping in the direction of a virtual speaker thus changing the relative amplification of the other virtual speakers on the soundstage. Any and all variations and combinations thereof are contemplated with embodiments of the present invention.

The positioning component 240 is responsible for creating and for orienting audio signals on the virtual soundstage with the changing orientation of the mobile device 202, or portions thereof, associated with a listener. In one embodiment, the positioning component 240 may include an decoder for interpreting configuration mapping between the audio channels of the audio signal and the speakers on the virtual soundstage. The audio channels are mapped such that the audio signal may be rendered for playing on headphones that simulate surround sound on a virtual soundstage. In particular, the mapping may include audio cues and position indicators for simulating surround sound and acoustic presence by maintaining the source of a sound based on orientation data for the mobile device. Maintaining the position of the source of a sound may include identifying individual parsed out sound components associated with a speaker of on the virtual soundstage and retaining the source of the sound components relative to the change in orientation of the listener as captured by the orientation component on the mobile device 202.

The virtual surround sound environment may be created in real-time or live using any set of two channel stereo headphones, and changed in real-time as the orientation of the mobile device 202 changes. Basically, the sound of the virtual soundstage moves synchronously as the listener turns. It is contemplated that embodiments of the present invention may also include stored virtual surround environments and configurations that may be played back on-demand. Virtual surround sound can include a multi-channel audio signal that is mixed down to a 2-channel audio signal. The 2-channel audio signal may be digitally filtered using virtual surround sound algorithms. The filtered audio signal may be converted into an analog audio signal by a digital-to-analog converter (DAC). The analog audio signal may further be amplified by an amplifier and output to left and right channels, i.e., 2-channel speakers. Since the 2-channel audio signal has 3 dimensional (3D) audio data, a listener can feel a surround effect.

At the positioning component 240, the analysis technique and algorithms may take the orientation data and a multi-channel audio input and send as output a 2 channel stereo signal that includes the 3D audio data as both position indicators and audio cues within the virtual soundstage intended to place the input channels in a simulated virtual soundstage. Positioning indicators may be based on orientation data received from the orientation component 220 and aural cues may be based on HRTF functions applied to the audio signal. In particular, the orientation component 230 can determine the position of the listener as captured by the mobile device. In embodiments the position comprises a location (e.g., a location variable) of a listener in, for example, n-dimensional and/or a direction of the listener (e.g., direction variable) in, for example, cardinal coordinates (N, S, E, W). The orientation changes can be determined using the one or more orientation data units that capture a change in the position, i.e., the location and/or direction of the mobile device associated with the listener. For example, a change in location can be captured in x, y, z coordinates and a change in direction captured in cardinal directions. Any variations of representations of positional changes and combinations thereof are contemplated in embodiments of the present invention. In this regard, the orientation data is communicated to the positioning component. The orientation component may either communication a first original position and a second position, and/or a change in from the first original position to the second position, where the orientation data information is incorporated into positioning virtual surround sound on a virtual soundstage.

The positioning component 220 is configured to apply the algorithms to orientation data and audio signal to develop position indicators and aural cues to sound waves, convincing the brain to experience virtual acoustic presence as though it came from multiple speakers in particular positions on a virtual soundstage. For example, DOLBY DIGITAL technology provides signal processing technology that delivers 7.1 channel surround sound over any pair of headphones for richer, more spacious headphone audio. Further, the change in position, captured at the orientation component, is referenced and the positioning component maintains the positioning of the surround sound elements. For example, an algorithm at the position component receives the change in position and in real-time the psychoacoustic calculations are maintained based on the previous position relative to the change in position.

Several variations of calculation to maintain the source of surround sound in providing acoustic presence are contemplated with embodiments of the present invention. In particular, the positioning information i.e., location and direction are processed into the virtual surround audio signal One or more of the position indicators and aural cues of the virtual surround sound are processed with the one or more of the different types of orientation data from the orientation component. For example, the location information x, y, z, and the direction information N, S, E, W may be used to recalibrate the virtual surround to maintain the source of sounds as the user moves. In this regard, the processing calculations may maintain the virtual surround sound only with reference to location or direction depending on the orientation data received from the orientation component 230. Further, the virtual surround sound experience is transformed by the orientation data in magnitude and direction of sound as recalculated for the position indicators and aural cues based on the processing the orientation data at the positioning component.

The positioning component 240 further leverage the mapping information associated with surround sound. As the surround sound format may include a mapping of each source channel into its own virtual speaker on the virtual soundstage, the algorithms may efficiently derive positioning information with the orientation data as described in embodiments of the present information, while factoring the mapping information of the audio signal to particular speakers. As such, the audio signal may utilize the mapping information in generating the position indicators and aural cues for playing of the audio signal. In particular, positioning the audio signal may further include positioning low-frequency effects directed to a speaker specifically designed for low-pitched sounds (e.g., subwoofer).

With continued reference to FIG. 2, the stereo output channels 242 and 244 create a virtual soundstage. In embodiments, the stereo output channels are played through headphones. The virtual soundstage 250 is a simulated physical environment created by the simulated surround sound experience. Virtual surround sound creates the perception that there are many sources (e.g., speakers 252) of sound than are actually present based the stereo output channels 242 and 244. In this regard, the virtual surround sound produces a multichannel surround sound experience on the virtual soundstage without the need for an equal number of actual physical speakers duplicating each perceived audio signal. The virtual surround sound through headphones provides a perceived surround sound experience on the virtual soundstage. As such, acoustic presence may be further simulated based on audio cues and orientation data referenced from the mobile device orientation component 230 as described herein.

Figure 3A:
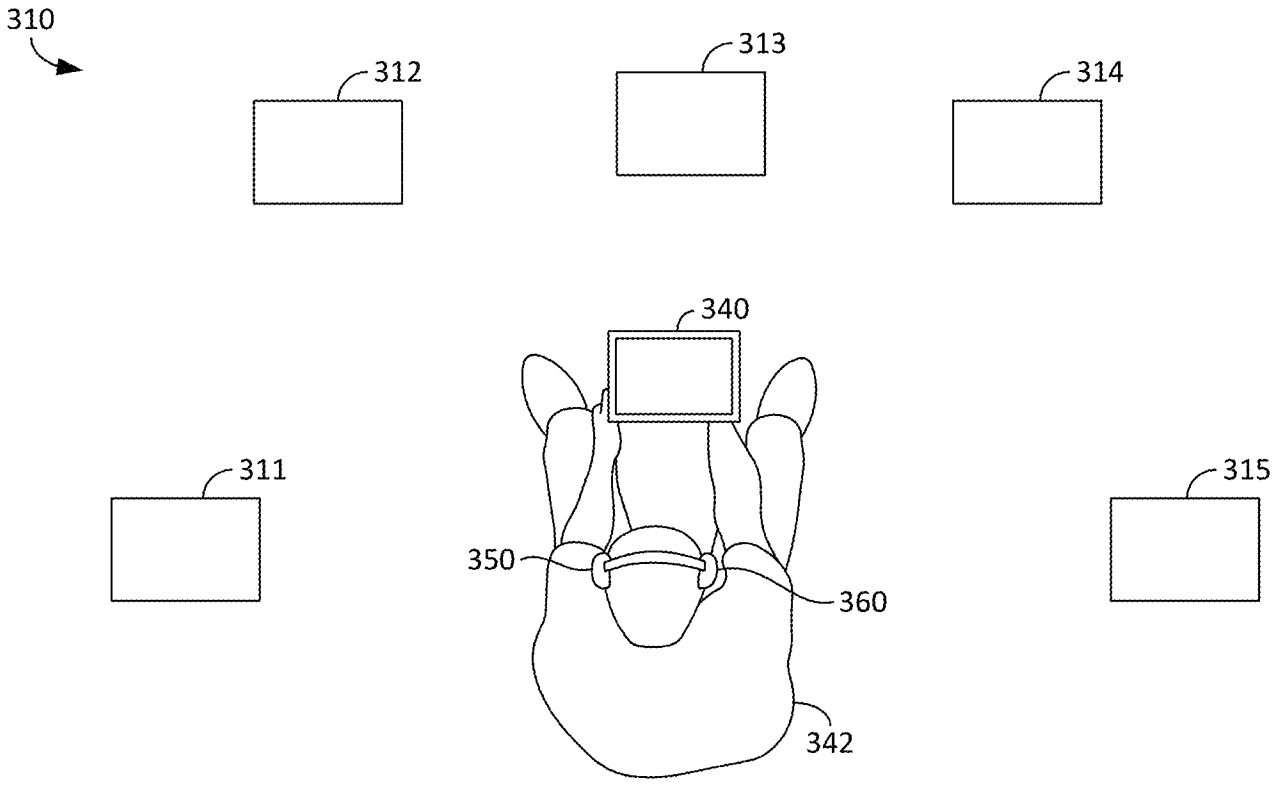
FIGS. 3A-3C depict a schematic illustrating a method for positioning audio signals on virtual soundstages, in accordance with an embodiment of the present invention.
Figure 3B:
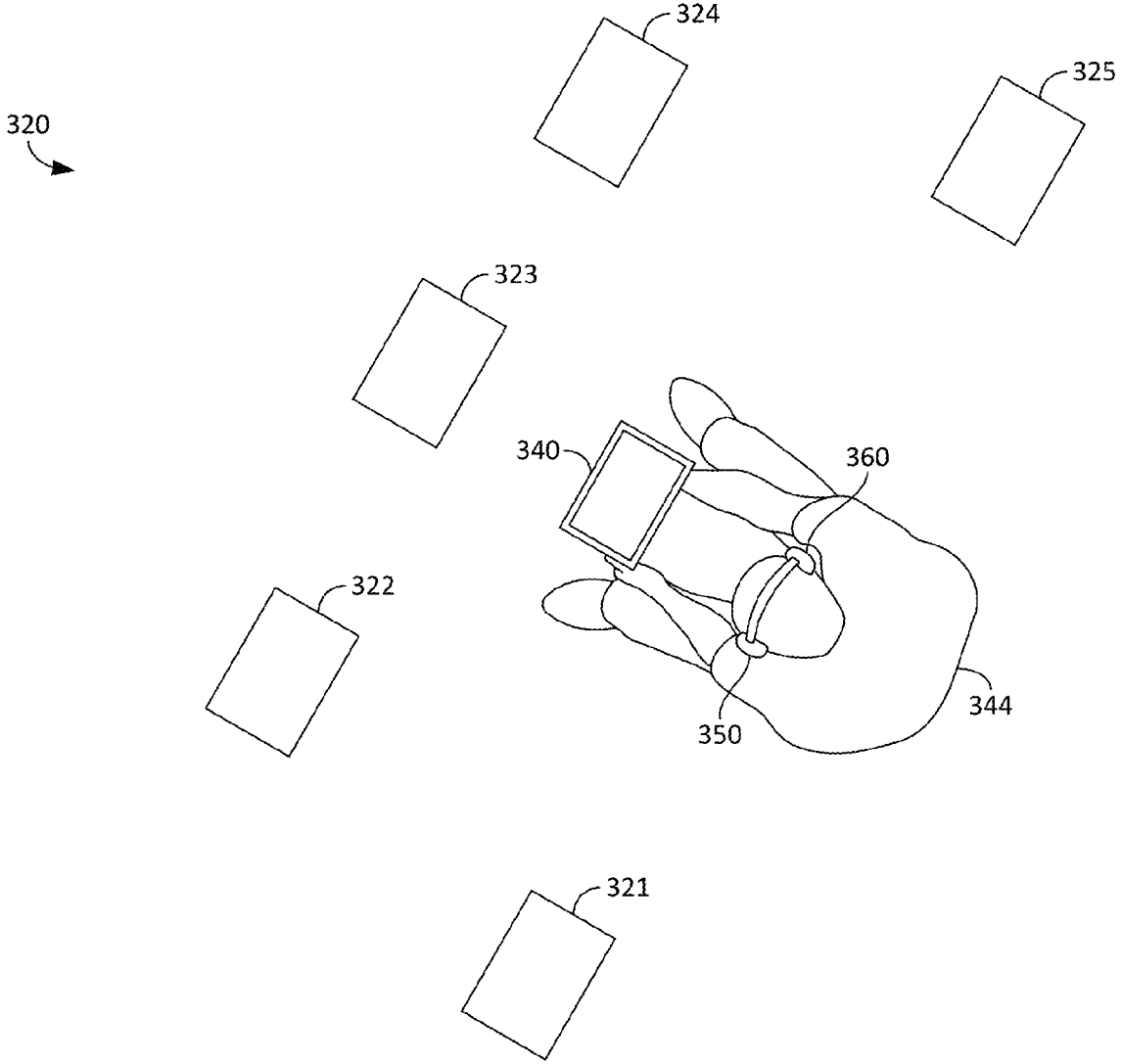
Figure 3C:
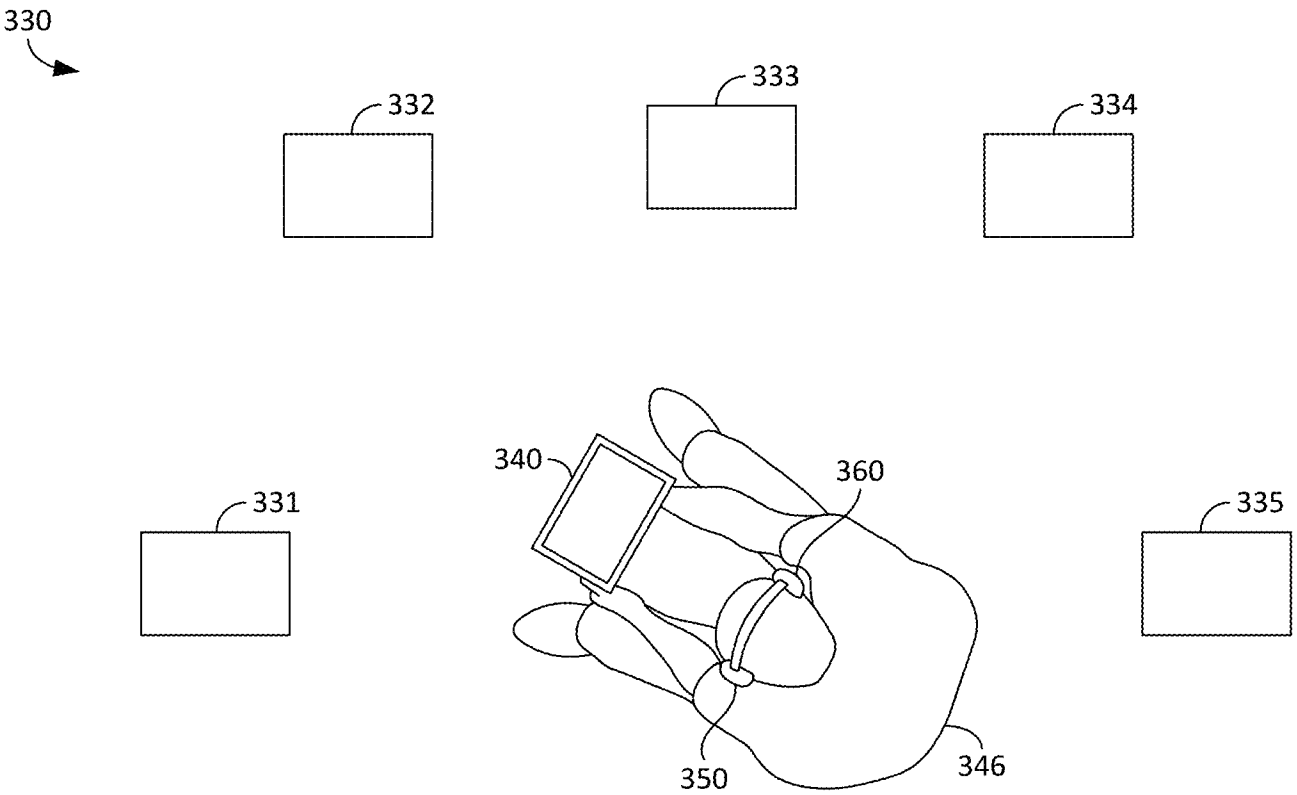

Turning to FIGS. 3A-3C, for purposes of a detailed discussion below, embodiments of the present invention are described with reference to a 5.1 channel surround sound setup; however the virtual soundstage is merely exemplary and it is contemplated that the techniques described may be extended to other implementation contexts (e.g., 7.1 and 11.1 surround sound). Virtual surround sound may provide an enhanced listening experience. With virtual acoustic presence, virtual surround sound is further experienced in a different manner. The source of the sound does not artificially rotate as a listener moves from position to position; however, the change in the position of the listener is tracked in order to provide a simulated acoustic presence, in that, the position of the source of the sound is maintained. For exemplary purposes, FIGS. 3A-3C include a first virtual soundstage 310, a second virtual soundstage 320, a third virtual soundstage 330, each having a mobile device 340, listener 350, and headphones 360. In this regard, FIG. 3A illustrates the first virtual soundstage 310 the listener 350 is listening to an audio signal with the mobile device 340 being positioned at first orientation 342. The audio signal may provide virtual surround sound (e.g., 5.1 surround sound) at virtual speakers 311, 312, 313, 314, and 315. A surround sound mix or a virtual surround sound mix provides horizontal and panoramic aspects and depth front-back aspects, thus, particular sounds may be panned within a two-dimensional virtual soundstage. For example, an expanded stereo mix for virtual surround sound may include instruments and vocals panned between left and right virtual speakers (e.g. 312 and 314), but lower levels sent to the rear virtual speakers (e.g. 311 and 315) to create a wider stereo image. In addition, lead sources such as the main vocals may be sent to the center virtual speaker (e.g. 313). Reverb and delay effects may be sent to the rear virtual speakers (e.g., 311 and 315) to create space. However, the mix of the surround sound may be experienced differently, as though a listener were present on the virtual soundstage in that the source of the sound with reference to the listener is maintained as the listener is in motion.

Now assume, on the second virtual soundstage 320, of FIG. 3B depicting a virtual soundstage without virtual acoustic presence, the listener 350 is listening to an audio signal with the mobile device 340 at second orientation 344. The listener 250 in the second orientation may have a 30° rotational difference from the first orientation 344. The audio signal may provide virtual surround sound for 5.1 surround sound at virtual speakers 321, 322, 323, 324, and 325. The mobile device does not support positioning the audio signal based on the orientation data of the mobile device 340. However, in accordance with embodiments of the present invention, the third virtual soundstage 330 in FIG. 3C depicting a virtual soundstage with virtual acoustic presence, the listener 350 is listening to an audio signal with the mobile device 340 at the third orientation 346. The third orientation may also have a 30° rotational difference from the first orientation 342. The audio signal may provide virtual surround sound for 5.1 surround sound at virtual speakers 331, 332, 333, 334, and 335. The mobile device 340 supports positioning the audio signal based on the orientation data of the mobile device. In this regard, listener experiences simulated acoustic presence with respect to the virtual surround sound, in that, the source of the sound does not artificially rotate as a listener moves from position to position; instead, the change in the position of the listener is tracked and the source position of the sound is maintained. For example, the virtual speaker 313 may simulate lead vocals on the virtual soundstage 310. On the virtual soundstage 320 the virtual speaker 322 may play the lead vocals; however, the position of the sound changed relative to the change in position of the listener 350. In contrast on virtual soundstage 330, the virtual speaker 333 does not change position, thus maintaining the source and position of the lead vocals relative to the change in the position of the listener 350.

Figure 4:
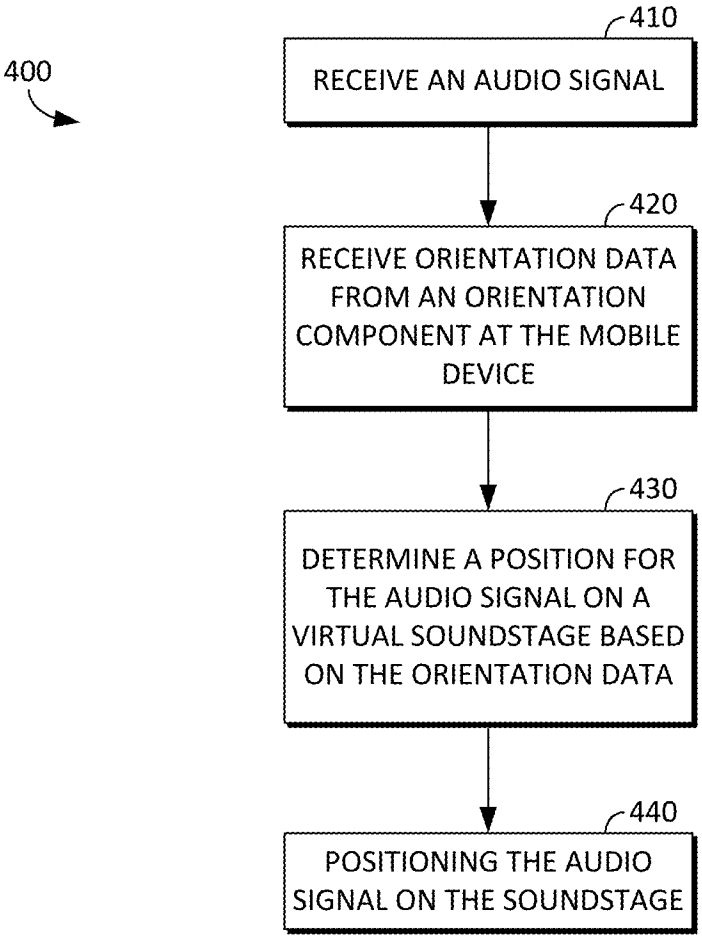
FIG. 4 depicts a flowchart illustrating a method for positioning audio signals on virtual soundstages, in accordance with an embodiment of the present invention.

Referring to FIG. 4, a flowchart illustrates a method 400 for positioning audio signals on virtual soundstages. Initially, at step 410, an audio signal is received. At step 420, orientation data from an orientation component at a mobile device is received, the orientation data is used for positioning the audio signal. The mobile device may be a mobile phone, a tablet, or headphones. The orientation component may be one or a combination of a magnetometer, accelerometer, and a gyroscope, for example. The orientation data may also be received via an interface that includes a direct manipulation interface having elements representing the virtual soundstage. At step 430, a position for the audio signal on a virtual soundstage is determined based on the orientation data. The virtual soundstage includes a plurality of virtual speakers that simultaneously simulate virtual surround sound and virtual acoustic presence for the audio signal.

Figure 5:
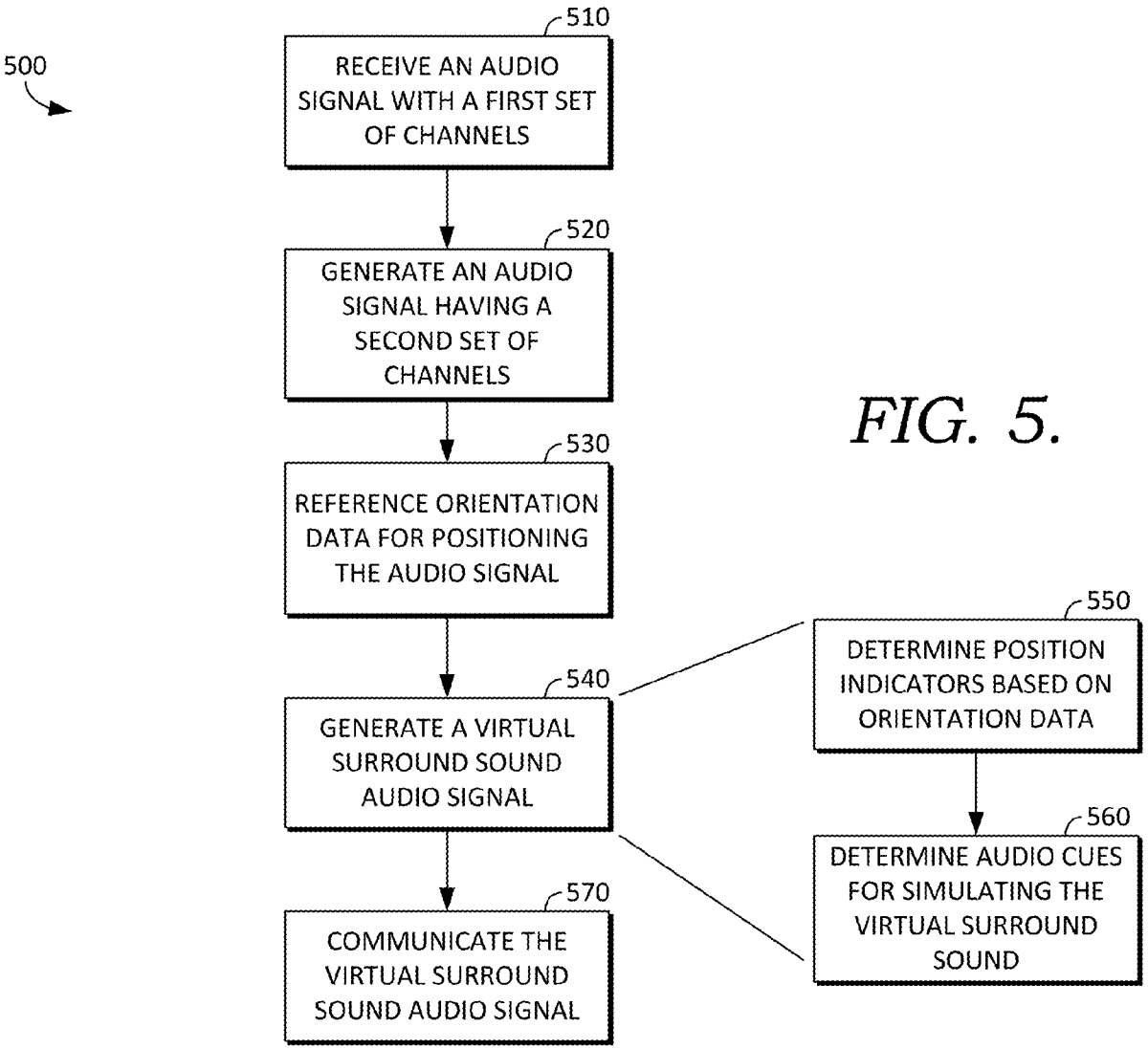
FIG. 5 depicts a flowchart illustrating a method for positioning audio signals on virtual soundstages, in accordance with an embodiment of the present invention.

FIG. 5 depicts a flowchart illustrating a method 500 for positioning an audio signal on virtual soundstages. At step 510, an audio signal having a first set of channels, is received. At step 520, an audio signal having a second set of channels is generated from the audio signal having the first set of channels. The second set of channels may be stereophonic channels. At step 530, the orientation data for positioning the audio signal having the second set of channels is referenced. At step 540, a virtual surround sound audio signal based on the orientation data and the audio signal having the second set of channels is generated. Generating the virtual surround sound audio signal comprises: at step 550, determining position indicators based on the orientation data for positioning the audio signal on the virtual soundstage; and at step 560, determining audio cues for simulating virtual surround sound for the audio signal. At step 570, the virtual surround sound audio signal comprising the position indicators and the audio cues is communicated to be played. The virtual audio signal is output to two audio channels that simulate a plurality of virtual audio channels on the virtual soundstage. The plurality of virtual audio channels provide virtual acoustic presence, where virtual acoustic presence maintains a sound position and source of a sound from each of the plurality of speakers of the virtual soundstage relative to a change in orientation of the listener Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated within the scope of the claims.

The invention claimed is:

1. Non-transitory computer-readable media having computer-executable instructions embodied thereon that, when executed, enable a computing device to perform a method for positioning audio signals on virtual soundstages, the method comprising:

receiving, at a mobile device, an audio signal;

interpreting, using a decoder of the mobile device, a configuration mapping of the audio signal to a virtual soundstage, wherein the configuration mapping comprises audio channels of the audio signal mapped to the virtual soundstage to simulate surround sound on a plurality of virtual speakers on the virtual soundstage, wherein the configuration mapping includes audio cues and position indicators, wherein the decoder interprets each of the audio cues and position indicators;

receiving orientation data from an orientation component at the mobile device, the orientation data used for positioning the audio signal; and maintaining a position for the audio signal on the virtual soundstage based on the orientation data and the configuration mapping, wherein maintaining the position for the audio signal is based on:

(1) identifying individual parsed sound components associated with the plurality of virtual speakers; and (2) retaining a source of sound components associated with the plurality of virtual speakers relative to a change in the mobile device position as captured in the orientation data.

2. The media of claim 1, wherein the audio signal is received from an internal audio source or an external audio source.

3. The media of claim 1, wherein the mobile device is a mobile phone, tablet device, or headphones.

4. The media of claim 1, wherein the orientation component comprises at least two of the following:

magnetometer;

accelerometer; and gyroscope.

5. The media of claim 1, wherein a direct manipulation interface having elements representing the virtual soundstage is configured using a user interface component for directly providing the orientation data for the virtual soundstage.

6. The media of claim 1, wherein the orientation data tracks the position of the mobile device.

7. The media of claim 6, wherein the position of the mobile device is configured in both the location variable and the direction variable.

8. The media of claim 6, wherein tracking the position of the mobile device is based on an origin position of the mobile device, wherein the origin position is a reference point for tracking changes in the position of the mobile device.

9. The media of claim 1, wherein positioning the audio signal on the virtual soundstage provides virtual acoustic presence, wherein the virtual acoustic presence maintains a sound position and source of a sound from each of the plurality of virtual speakers of the virtual soundstage relative to a change in orientation of a listener.

10. The media of claim 9, wherein the change in orientation of the listener is measured based on the orientation data from the mobile device.

11. The media of claim 9, wherein the virtual soundstage comprises the plurality of virtual speakers that simultaneously simulate the virtual surround sound and the virtual acoustic presence for the audio signal.

12. The media of claim 1, wherein the virtual soundstage comprises at least 3 virtual speakers including a low-frequency effects virtual speaker.

13. Non-transitory computer-readable media having computer-executable instructions embodied thereon that, when executed, enable a computing device to perform a method for positioning audio signal on virtual soundstages, the method comprising:

receiving, at a mobile phone or tablet, an audio signal having a first set of channels;

storing the audio signal having the first set of channels in a memory of the mobile phone or tablet;

generating, at the mobile phone or tablet, from the audio signal having the first set of channels, an audio signal having a second set of channels;

referencing, at the mobile phone or tablet, orientation data from the mobile phone or tablet, the orientation data utilized for positioning the audio signal having the second set of channels;

generating, at the mobile phone or tablet, a virtual surround sound audio signal, wherein generating the virtual surround audio signal comprises:

(1) determining, using a decoder, position indicators based on the orientation data for positioning the audio signal on a plurality of virtual speakers on a virtual soundstage; and (2) determining, using the decoder, audio cues for simulating virtual surround sound for the audio signal;

communicating, from the mobile phone or tablet, the virtual surround sound audio signal comprising the position indicators and the audio cues to headphones operably connected to the mobile phone or tablet, wherein the virtual surround sound audio signal is output to two audio channels that simulate a plurality of virtual audio channels on the plurality of virtual speakers on the virtual soundstage;

referencing a change in the orientation data from an orientation component at the mobile device or tablet;

maintaining a position for the audio signal on the virtual soundstage based on the change in orientation data and the position indicators and the audio cues, wherein maintaining the position of the audio signal is based on:

(1) identifying individual parsed sound components associated with the plurality of virtual speakers; and (2) retaining a source of sound components associated with the plurality of virtual speakers relative to a change in the mobile device position as captured in the orientation data.

14. The media of claim 13, wherein the second set of channels are stereophonic channels.

15. The media of claim 13, wherein the audio cues and the position indicators, map information from the second set of channels to the plurality of virtual audio channels.

16. The media of claim 13, wherein the plurality of virtual audio channels comprises at least one low-frequency effects channel.

17. The media of claim 13, wherein the plurality of virtual audio channels provide virtual acoustic presence, wherein the virtual acoustic presence maintains on a sound position and source of a sound from each of the plurality of speakers of the virtual soundstage relative to a change is orientation of a listener.

18. A system for positioning audio signals on virtual soundstages, the system comprising:

an orientation component configured for:

(1) generating orientation data of a mobile device, wherein the orientation data tracks directional changes of the mobile device; and (2) communicating the orientation data for positioning an audio signal based on the orientation data, wherein the orientation data includes multidimensional positioning data; and a positioning component configured for:

(1) using, a decoder, to interpret a configuration mapping of the audio signal to a virtual soundstage, wherein the configuration mapping comprises audio channels of the audio signal mapped to the virtual soundstage to simulate surround sound on a plurality of virtual speakers on the virtual soundstage, wherein the configuration mapping includes audio cues and position indicators, and wherein the audio cues comprise spatial cues and timing cues simulate the audio signal as originating from multiple speakers on the virtual soundstage;

(2) receiving orientation data from the orientation data used for positioning the audio signal; and maintaining a position for the audio signal on the virtual soundstage based on the orientation data and the configuration mapping, wherein maintaining the position for the audio signal is based on:

(1) identifying individual parsed sound components associated with the plurality of virtual speakers; and (2) retaining a source of sound components associated with the plurality of virtual speakers relative to a change in the mobile device position as captured in the orientation data.

19. The system of claim 18, wherein the received audio signal is used to generate stereophonic channels that is used in generating the virtual surround sound audio signal.

20. The system of claim 19, wherein the virtual surround sound audio signal is output to two audio channels that simulate a plurality of virtual audio channels on the plurality of virtual speakers of the virtual soundstage.

* * * * *